US005255727A

United States Patent [19]

Saruwatari et al.

[11] Patent Number: 5,255,727

[45] Date of Patent: Oct. 26, 1993

[54] PROTECTIVE DOOR COVER AND METHOD OF MAKING

[76] Inventors: Ruby A. Saruwatari; John B. Saruwatari, both of 1520 Washington Ave., Santa Ana, Calif. 92701

[21] Appl. No.: 811,567

[22] Filed: Dec. 20, 1991

[51] Int. Cl.[5] ..... B65D 75/28

[52] U.S. Cl. ..... 150/154; 206/321

[58] Field of Search ..... 150/154, 155; 206/321

[56] References Cited

U.S. PATENT DOCUMENTS

| | | | |
|---|---|---|---|
| 1,675,147 | 6/1928 | Walter | 206/321 X |
| 2,930,480 | 3/1960 | Brown | 206/325 |
| 3,143,154 | 8/1964 | Best | 150/154 |
| 3,185,197 | 5/1965 | Spiro et al. | 150/154 |
| 4,372,364 | 2/1983 | Katz | 150/154 |
| 4,674,787 | 6/1987 | DeVera | 150/154 X |
| 4,782,873 | 11/1988 | Messner et al. | 150/159 |
| 4,954,384 | 9/1990 | Hartwell | 150/165 X |
| 5,042,656 | 8/1991 | Kahre | 206/321 |

*Primary Examiner*—Sue A. Weaver

*Attorney, Agent, or Firm*—James G. O'Neill

[57] ABSTRACT

A two piece door cover assembly for attachment to a door to protect all sides and edges of the door on which it is mounted, while allowing the door so protected to be fully functional, so as to be opened, closed and locked. The two main sections are each easily constructed from a piece or pieces of material, with a further protective layer, lining or sheet of material sandwiched within a pocket formed from folded over and fixed together segments thereof. The two sections of the protective door covers may be custom made for uniquely mounted or sized doors, custom hardware on the door, or assembled in standard sizes to fit most doors.

20 Claims, 4 Drawing Sheets

PROTECTIVE DOOR COVER AND METHOD OF MAKING

BACKGROUND OF THE INVENTION

1. Field of the Invention

This invention relates generally to door covers and more particularly to an improved protective door cover and method of making the same.

2. Description of Related Art

The exterior sides and edges of interior and exterior doors of residences, commercial buildings, offices, etc. are subjected to accidental abuse, damage, marking or mistreatment, particularly during construction, moving, painting, remodeling, or the like. Due to the high cost of labor to repair or replace, as well as the inconvenience of removing, repairing and/or replacing doors mounted in a door frame, it is necessary to somehow protect the vulnerable surfaces of doors from accidental damage or harm because of dripping paints or plasters, or contact by moving objects, such as furniture, tools, wall portions, or the like.

Means for covering doors to protect them against damage or harm, are known. These known means are generally of the disposable type, are not designed to fit all doors, or all edges and both sides of single door or double doors, and do not allow the doors so covered thereby to function properly so as to be opened, closed and locked in a usual manner. Therefore, after many attempts to solve the problems of ease in using and manufacturing a relatively low-cost and reusable protective door cover there still exists the need in the door protecting art for a relatively simple, easy to install and remove, low-cost protective door cover that may be made to cover all sides of substantially all doors, while at the same time allowing the door to function normally and be opened, closed and locked for everyday use.

One such known prior art door cover is shown in U.S. Pat. No. 4,372,364, which discloses an adjustable length door protector for one side of a door only, which is hung from the top of a door by an upper end pocket. The bottom of the protector is folded-up and fixed to Velcro strips to form a double thickness pad at the base of the side of the door being protected.

U.S. Pat. No. 5,042,656 discloses a disposable door protector in which the protector is formed as a large plastic sheath envelope that is pulled onto the edge of the door opposite the door edge hinged to the frame to cover the entire door, including the top and bottom edges, the locking/closure mechanism and the handles. The door, covered by this disposable envelope, therefore, cannot be opened or closed with the envelope thereon.

U.S. Pat. Nos. 3,185,197, 4,620,396, 4,782,873 and 4,954,384 disclose covers for other specific items (not doors) having Velcro closure or securing means for holding the covers in place, or for securing the covers together.

While the foregoing mentioned prior art covers have provided some limited improvements and overcome some of the problems in damage caused to doors when rooms are being painted or furniture is being moved, and disclose the use of Velcro closure or securing means in various types of covers, they tend to be limited in application, are of the disposable type, or are not designed to fit all doors, or both the front and back sides of a single door, or a set of double doors, and do not allow the doors so covered to be opened and closed in a normal manner.

SUMMARY OF THE INVENTION

Accordingly, it is a general object of the present invention to provide an improved method for protecting a door. It is a particular object of the present invention to provide an improved method for constructing a protective door cover. It is a still more particular object of the present invention to provide an improved protective door cover assembly. It is yet a more particular object of the present invention to provide an improved protective door cover assembly having two sections. It is a further object of the present invention to provide a method and cover that meets the demanding requirements of modern building managers and owners, and which, at the same time, meet the more exacting environmental concerns of less waste of materials and energy, by reusing the same cover over and over again and on different sizes and types of doors.

In accordance with one aspect of the present invention, there is provided a two piece door cover assembly for attachment to a door to protect the same. This assembly provides protection to the most vulnerable front and rear areas as well as the side edges of the door on which it is mounted, while allowing the door so protected to function in a normal manner. Furthermore, the two sections of the door cover of the present invention are each easily constructed from a single piece of material with a door protective lining of material sandwiched between folded over and fixed together segments thereof. Additionally, the method allows protective door covers to be custom made for uniquely mounted or size doors, as well as standard size covers to fit most doors of a particular type.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

Figure 5:
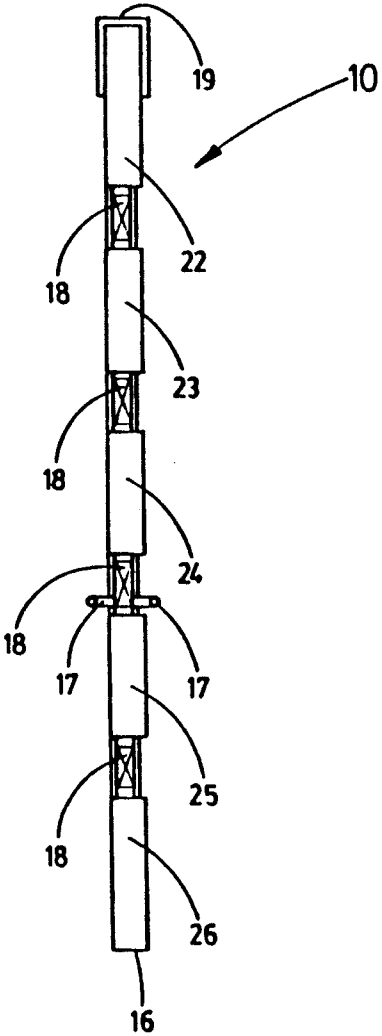
FIG. 5 is a side elevational view of the hinged end of the door of FIG. 1, with the cover assembly thereon.

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for an improved protective door cover assembly, generally indicated at 10 in the attached drawings. As shown more clearly in FIGS. 1, 2, 5 and 6, the cover 10 is preferably composed of two pieces or sections, namely, first and second main sections 12, 14, secured together and substantially, completely surrounding and covering a door 16, having handles 17 on both sides thereof for operating a locking/closure mechanism 15 (see FIG. 5) extending from one side edge of the door. A plurality of hinges 18 on the other side edge are used to mount the door 16 to a door frame in a known manner. If desired, although not required to keep the sections 12, 14 on the door, a plurality of straps 19, of a predetermined length, may be draped or looped over the top of the door 16. These straps 19 aid or assist in holding the cover 10 on the door by further suspending the two sections 12 and 14 from the top of the door. Also, the straps 19 help in fixing or locking the top portions of the two sections together.

Each of the sections includes a plurality of extensions, finger-like portions, or flaps, such 20 and 21 on section 12, and 22–26 on section 14. These extensions or flaps include fastening or securing means, such as the hook or loop portion of VELCRO strips 27–33 fixed on the ends thereof. These flaps wrap around the side edges of the door, so that the hook or loop securing means coact with and are releasably secured to a plurality of loop or hook portions of VELCRO strips 34–40 fixed on the exterior surfaces of the sections. Furthermore, each of the straps 19 include securing means, such as VELCRO strips on the ends thereof which coact with and are secured to further VELCRO securing means, such as 41–46, fixed on the outside surfaces of the main sections 12 and 14.

Figure 3:
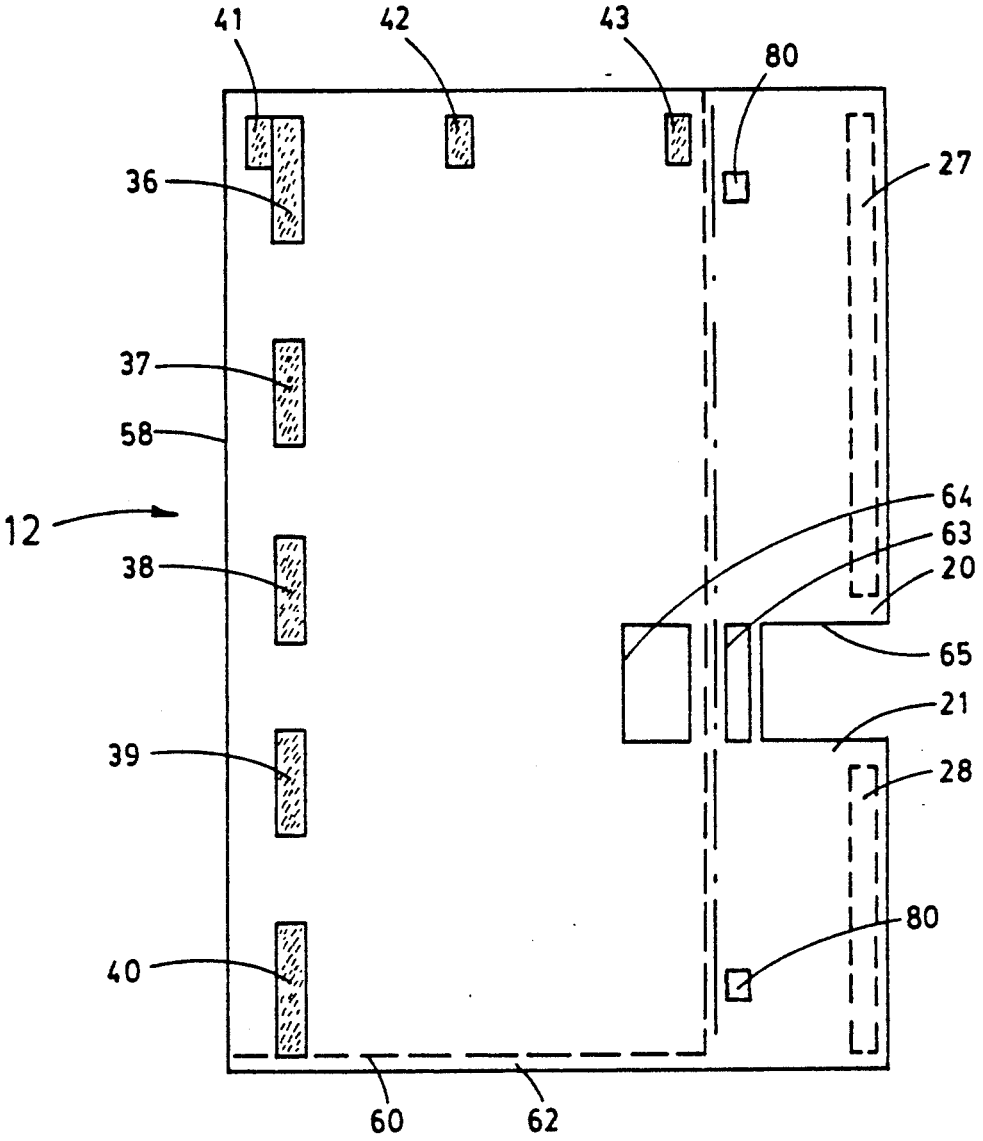
FIG. 3 is a front elevational view of an open first section of the protective door cover assembly, to be hung on one side of a door.

Turning now to FIGS. 3, 4, 7 and 8, there shown are the sections 12, 14, in opened, assembled and unassembled positions. In particular, FIG. 3 shows the first section 12 assembled, in a flattenened or opened position, before mounting on one side of a door. The side of the door the section 12 will be mounted on will depend on how the door is hung, or to be hung in a door frame; i.e., on what side edges of the door the hinges and locking mechanism are mounted.

Figure 8:
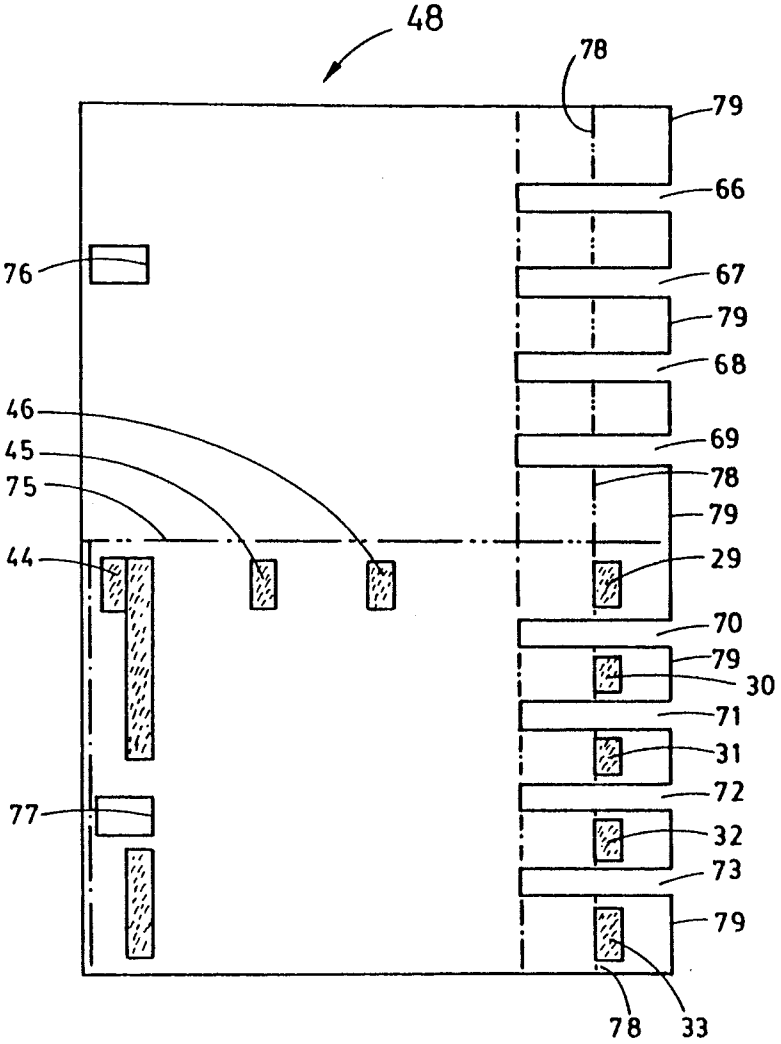
FIG. 8 is a front elevational view of the preferred piece of fabric from which the second section of FIG. 4 is made.
Figure 7:
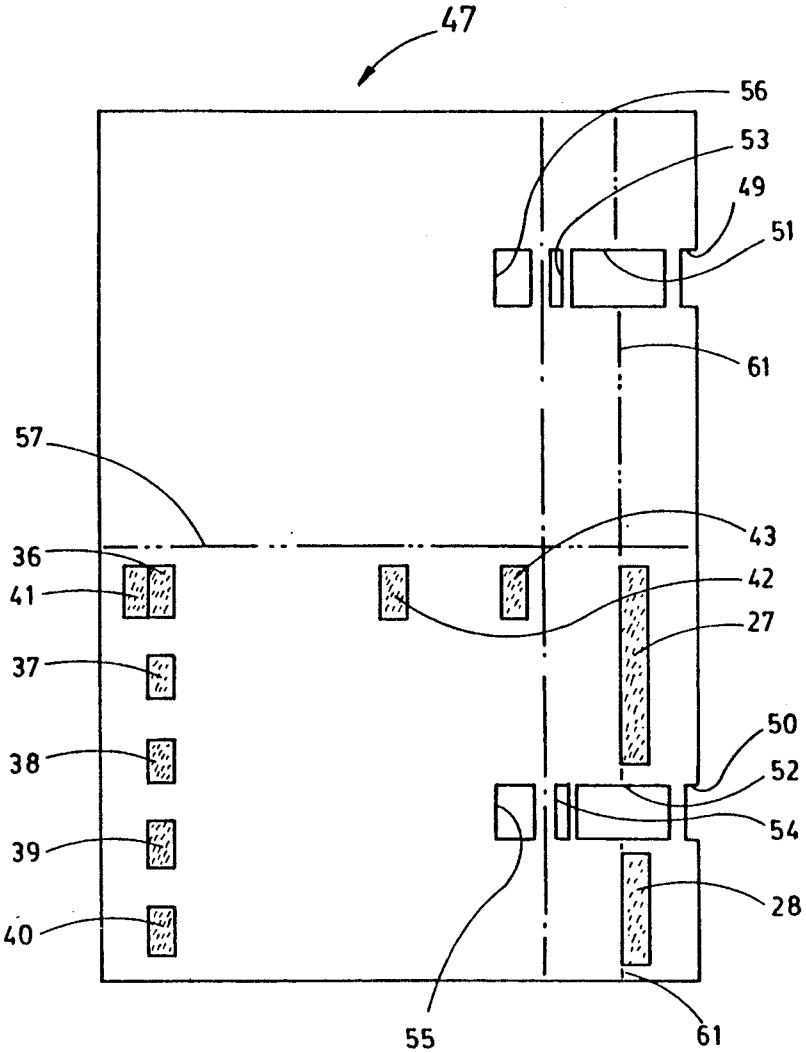
FIG. 7 is a front elevational view of the preferred piece of fabric from which the first section of FIG. 3 is made.

Both sections are preferably manufactured or assembled from one piece of material, such as 47, 48, as shown in FIGS. 7 and 8, but could, of course, be formed from or more different fabrics and or pieces in a manner known to those skilled in the art, if required or needed. The preferred material used may be a natural or artificial fabric, so long as it is sturdy and durable, as well as resilient and easily cleaned. Examples of materials that have been used on prototypes are a heavy canvas or duck. Other fabrics or woven materials may be used, so as they are formable into sections which can support inserts and be hung on, wrapped around a door and coact with another section to protect the door. A coating could also be applied to the material used to make the cover sections waterproof, in a manner known to those skilled in the art, or to otherwise protect the fabric and/or to make it easily cleanable. The material used for both sections should also lend itself to being easily secured together along its edges, as by use of an adhesive, sewing, or other means known to those skilled in the art to form the completed sections 12, 14 shown in FIGS. 3 and 4.

As is shown most clearly in FIG. 7, the section 12 is constructed by first cutting or forming a plurality of openings 49–56 in the material, as by using a pattern or other guide means to show where such openings should be made. This will, in turn, depend on the size of the door(s) on which the finished section 12 is to be hung, and the hardware on such a door. Fastening means, such as the securing means 27, 28, and 36–43 are then secured or fixed to the material 47 in predetermined positions and the material 47 is folded over, or in half, along a seam 57, shown in broken line. When folded along seam 57, the openings and the edges will be aligned and then secured together, as by an adhesive, sewing, or the like. Before all the edges are secured together, one side edge, such as side edge 58 (FIG. 3) is left open to form an interior envelope into which a substantially rectangular, protecting liner and/or stiffening material, padding, or panel 60 is inserted and captured. The line or padding may be cotton, felt, polyester, wool, or the like, while the liner, stiffening material or panel may be stiff plastic, wood, or the like, approximately ⅛ inch thick. This final side edge 58 is then fixed together in the same as the other side edges thereof, to form the completed main section 12.

After being folded along seam 57, an other or opposite side edge 61 of section 12 is formed by folding the now folded material 47 along a seam 61 which forms this edge 61 (see broken line in FIG. 7) and securing the outer edge (FIG. 7) to the inside or rear of the section 12 (when looking at FIG. 3). This forms a quadruple material for protecting the edge of the door which it covers.

The inserted liner or panel of material 60 is made slightly smaller than the rectangular portion of section 12 into which it is captured so as to allow or form a small, thinner strip of material 62, which will be aligned along the locking and bottom outside edges of a door, such as 16, on which the section 12 is mounted. This thinner strip of material allows the door 16 to be closed against the door jamb of a frame in which it is held so the locking/closure mechanism 15 may catch and hold through an opening 63 (see FIG. 6) formed by the two openings 53, 54 of material 47 when the section 12 is finished. Further openings 64 and 65 for handles 17 are formed when the openings 49–52, 55 and 56 are brought together.

Figure 1A:
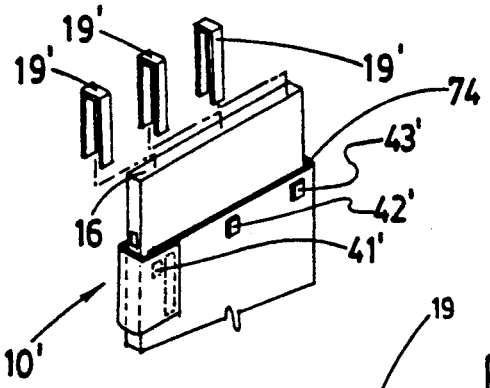
FIG. 1A is a partial perspective view of a door having a closure or the like thereon, with the protective door cover stopping short of the first hinge.
Figure 1:
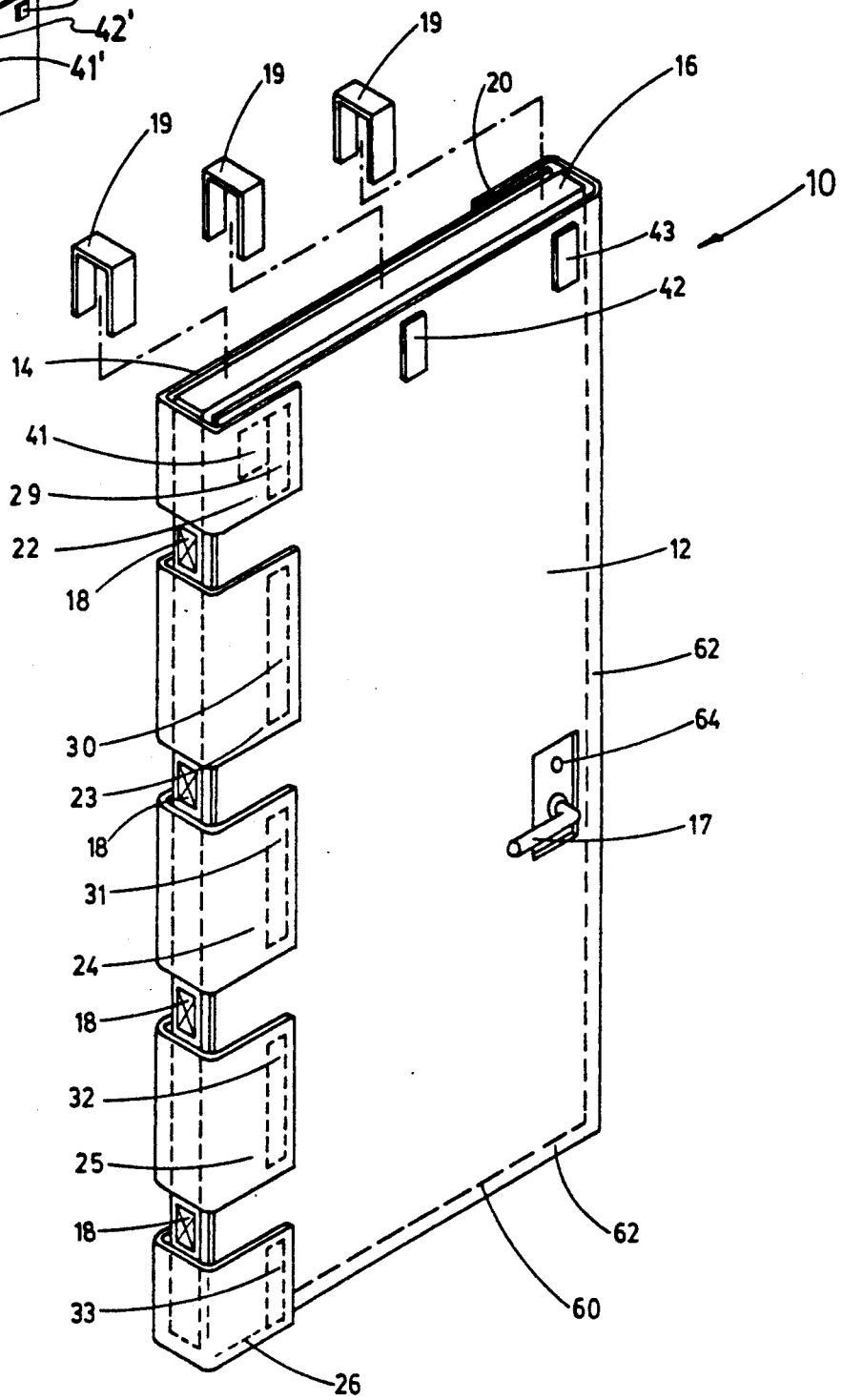
FIG. 1 is a perspective view of a door with a protective door cover of the present invention mounted thereon.
Figure 2:
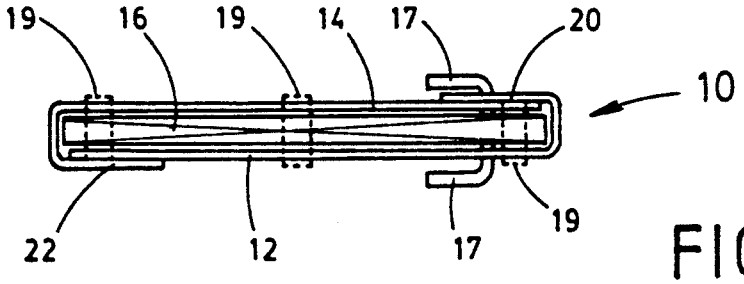
FIG. 2 is a top plan view of the door and protective cover of FIG. 1.

Turning now to FIG. 8, the section 14 is constructed similarly to section 12, by first cutting or forming a plurality of openings 66–73, 76 and 77 in the material 48, as by using a pattern or other guide means to show where such openings should be made. This will, in turn, depend on the size of the door(s) on which the finished section 14 is to be hung, and the hardware on such a door. If the door on which the sections are to be hung includes a door closer, or the like, fixed to the top of the door (see 10' in FIG. 1A), as is the case with many outside or inside doors in offices, commercial or retail businesses, the material 48, as well as the material 47 for section 12 would merely be made shorter. Additionally, at least two openings, such as 66 and 73 would be eliminated. In such a case, the sections 12 and 14 would end at line 74 on door 16, as shown in FIG. 1A, with the straps 19' made longer and the fastening means for the straps in the positions 41', 42' and 43', as shown in FIG. 1A.

Fastening means 29–35 and 44–46 are secured or fixed to the material 48 in predetermined positions and the material 48 is folded over, or in half, along a seam 75, shown in broken line in FIG. 8. When folded along seam 75, the openings and the edges will be aligned and then secured together in the same manner as the edges of the section 12. A lining or panel, such as 60 of section 12, may also be inserted into and held in section 14 in the same manner, if desired. A small portion of the edge of section 14 would also be made thinner, so that this section could be closed in a door frame. An opening 81 for a door handle 17 is formed in the completed section 14 by the openings 76, 77.

Figure 4:
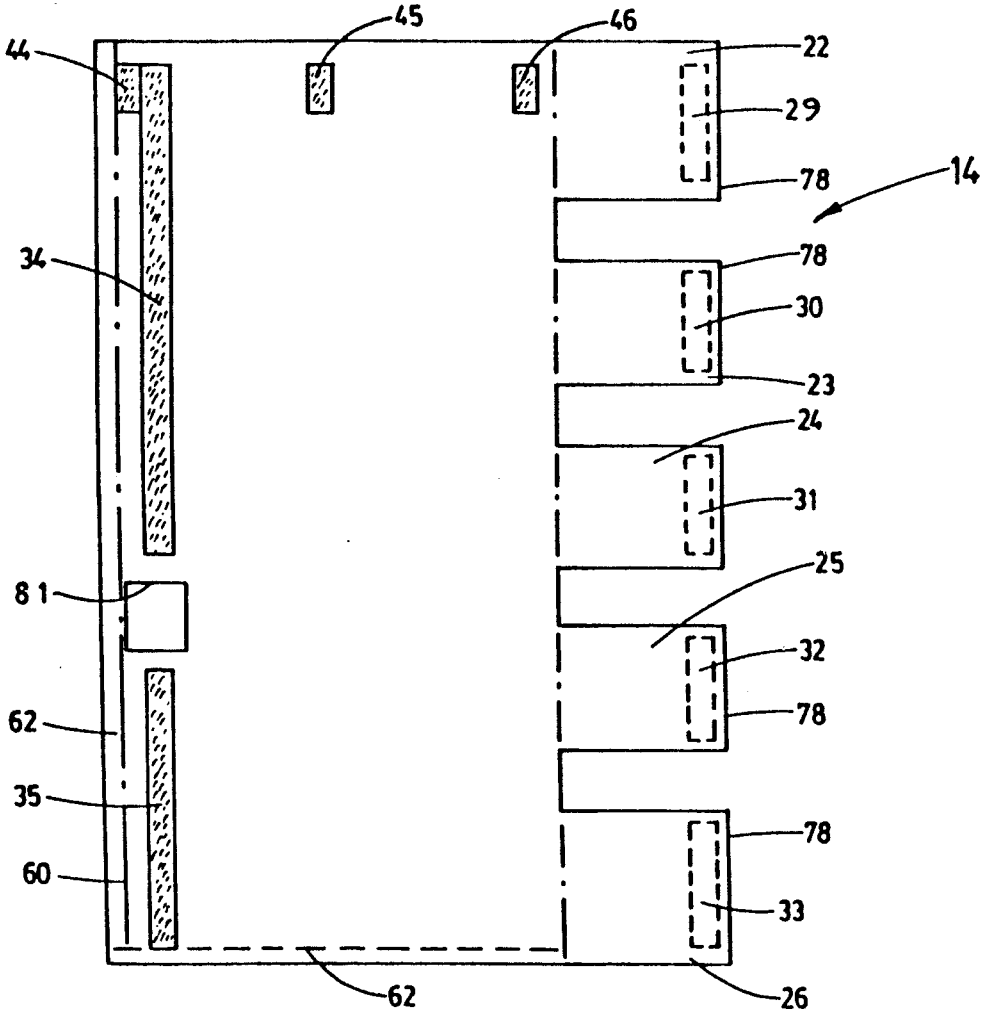
FIG. 4 is a front elevational view of the other section of the protective door cover assembly in the open position before hanging on the other side of the door and secured together with the section of FIG. 3.

After being folded along seam 75, a sawtoothed side edge 78 of section 14 is formed by folding the now folded material 48 along this edge 78 (see broken line 78 in FIG. 8) and securing outer edges 79 (FIG. 8) to the inside or rear of the section 14 (when looking at FIG. 4).

Figure 6:
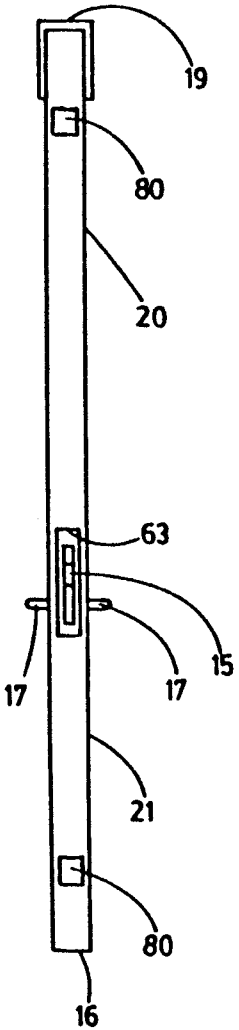
FIG. 6 is a side elevational view of the other end of the door of FIG. 1, containing the closure/locking mechanism, with the cover assembly thereon.

If the cover is to be mounted on a double set of doors, a pair of openings, such as those shown at 80 in FIGS. 3 and 6 may be formed in either section to allow upper and lower locking plates to function, by first making the desired number of openings in the material, such as 47.

It, therefore, can be seen that the present invention provides an improved and novel door cover that allows doors of various sizes to be easily and quickly covered, by the main sections being hung on, wrapped around the door and secured together, by a single person, to protect substantially all, if not all of the surfaces of such a door from damage. Furthermore, the size of the main sections of the protective cover may be specifically configured so as to work on any door. The sections may be custom made to fit a specific door, or made by the disclosed method in large quantities to fit standard size doors. The insertable panel in the door cover, in either or both sections, provides additional protection to the protected surface of the door, while allowing the door to be continued to used, as if uncovered. Furthermore, because of its durability and ease in use, the door cover of this invention may be used over and over again, saving time, money, materials and energy.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A protective door cover adapted to cover and protect the front and back surfaces, and side edges of a door hung in a frame, said cover comprising:

first and second sections adapted to be secured together over and around said door;

each of said first and second sections having a substantially rectangular shaped portion dimensioned for covering substantially all of the front or back surface of said door on which it is mounted, and a plurality of extending portions fixed to the substantially rectangular shaped portion thereof;

the plurality of extending portions of said first section sized to wrap around one of the side edges of said door and cooperate with the substantially rectangular shaped portion of said second section, while the plurality of extending portions of said second section are sized to wrap around one of the side edges of said door and cooperate with the substantially rectangular shaped portion of said first section; and securing means fixed to the substantially rectangular shaped portion of each of said first and second sections coacting with the holding complementary securing means fixed to said plurality of extending portions from the substantially rectangular shaped portion of the one of said first and second sections from which said plurality of extending portions did not extend to thereby hold said first and second sections together around said door.

2. The protective door cover of claim 1, further including a panel permanently secured within an envelope formed in the substantially rectangular shaped portion of at least one of said first and second sections.

3. The protective door cover of claim 2 wherein each of said substantially rectangular shaped portions includes a panel therein, and said panel is formed from a stiff material.

4. The protective door cover of claim 3 wherein each of said panels is rectangular and approximately one-eighth of an inch thick.

5. The protective door cover of claim 1 wherein said securing means is a plurality of VELCRO strips.

6. The protective door cover of claim 1, further including a padding material liner permanently secured within an envelope formed in the substantially rectangular shaped portion of at least one of said first and second sections.

7. The protective door cover of claim 6 wherein each of said substantially rectangular shaped portions includes a padding material liner therein, and said padding liner is formed from a flexible material.

8. The protective door cover of claim 1 wherein one of said first and second sections includes at least two of said plurality of extending portions fixed to said substantially rectangular shaped portion thereof, which two extending portions are sized to wrap around the side edge of said door which contains a locking means.

9. The protective door cover of claim 8 wherein said one of said first and second sections includes a plurality of openings formed therein sized to receive a pair of door handles mounted on said door and said locking means.

10. The protective door cover of claim 9 wherein said securing means is a plurality of VELCRO strips.

11. The protective door cover of claim 1 wherein a second of said first and second sections includes at least three of said plurality of extending portions fixed to the substantially rectangular shaped portion thereof, which at least three extending portions are sized to wrap around the side edge of said door which contains hinge means.

12. The protective door cover of claim 11 wherein said second of said first and second sections includes an opening formed therein sized to receive a door handle mounted on said door and coating with a locking means.

13. The protective door cover of claim 12 wherein said securing means is a plurality of VELCRO strips.

14. The protective door cover of claim 13, further including a plurality of straps dimensioned to be secured to fastening means on each of said first and second sections and looped over the top of said door to further secure said cover to said door and said first and second sections to each other.

15. The protective door cover of claim 1, further including a plurality of straps dimensioned to be secured to fastening means on each of said first and second sections and looped over the top of said door to further secure said cover to said door and said first and second sections to each other.

16. A protective door cover adapted to cover and protect the front and back surfaces, and side edges of a door hung in a frame, said cover comprising:

first and second sections adapted to be secured together over and around said door;

each of said first and second sections having a substantially rectangular shaped portion dimensioned for covering substantially all of the front or back surface of said door on which it is mounted, and a plurality of extending portions fixed to the substantially rectangular shaped portion thereof;

the plurality of extending portions of said first section sized to wrap around one of the side edges of said door and cooperate with the substantially rectangular shaped portion of said second section, while the plurality of extending portions of said second section are sized to wrap around one of the side edges of said door and cooperate with the substantially rectangular shaped portion of said first section;

an envelope formed in the substantially rectangular shaped portion of each of said first and second sections and a lining held therein; and securing means comprising a plurality of VELCRO strips fixed to the substantially rectangular shaped portions of each of said first and second sections coacting with and holding complementary VELCRO strips fixed to said plurality of extending portions from the substantially rectangular shaped portion of the one of said first and second sections from which said plurality of extending portions did not extend to thereby hold said first and second sections together around said door.

17. The protective door cover of claim 16 wherein said lining is a rectangular pad of flexible material.

18. The protective door cover of claim 16 wherein said lining is a rectangular panel formed from a stiff material, approximately one-eighth of an inch thick.

19. The protective door cover of claim 18 wherein said panel is formed from a stiff plastic material.

20. The protective door cover of claim 16 wherein one of said first and second sections includes at least two of said plurality of extending portions fixed to the substantially rectangular shaped portion thereof, which at least two extending portions are sized to wrap around the side edge of said door which contains a locking means, and a plurality of openings formed therein and dimensioned to receive a pair of door handles mounted on said door and said locking means; and wherein the other of said first and second sections includes at least three of said plurality of extending portions fixed to the substantially rectangular shaped portion thereof, which at least three portions are adapted to wrap around the side edge of said door which contains hinge means, and an opening formed therein dimensioned to receive one of said door handles.

* * * * *